US007986274B2

(12) United States Patent
Yang et al.

(10) Patent No.: US 7,986,274 B2
(45) Date of Patent: Jul. 26, 2011

(54) MULTI-BAND ANTENNA

(75) Inventors: Wen-Chieh Yang, Taipei Hsien (TW); Kai Shih, Taipei Hsien (TW); Yu-Yuan Wu, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 373 days.

(21) Appl. No.: 12/398,371

(22) Filed: Mar. 5, 2009

(65) Prior Publication Data

US 2010/0225551 A1 Sep. 9, 2010

(51) Int. Cl.
*H01Q 1/38* (2006.01)

(52) U.S. Cl. ..... 343/700 MS; 343/702

(58) Field of Classification Search ..... 343/343, 343/702, 846

See application file for complete search history.

(56) References Cited

U.S. PATENT DOCUMENTS

| | | | | |
|---|---|---|---|---|
| 2006/0082506 | A1* | 4/2006 | Fang | 343/700 MS |
| 2009/0146906 | A1* | 6/2009 | Anguera Pros et al. | 343/906 |
| 2009/0174611 | A1* | 7/2009 | Schlub et al. | 343/702 |
| 2010/0149069 | A1* | 6/2010 | Kim | 343/904 |

* cited by examiner

*Primary Examiner* — HoangAnh T Le

(74) *Attorney, Agent, or Firm* — WPAT, P.C.; Anthony King

(57) ABSTRACT

A multi-band antenna includes a ground portion, a radiating element spaced from the ground portion, a tuning conductor extending from the radiating element and parallel to the ground portion to form a gap therebetween, a short-circuit conductor interconnecting the ground portion and the radiating element, and a feed point disposed at the radiating element and adjacent to the short-circuit conductor. The radiating element, the short-circuit conductor and the feed point function as a first inverted-F antenna obtaining a first high frequency band, and a second inverted-F antenna obtaining a low frequency band and a second high frequency band higher than the first high frequency band. The ground portion and the tuning conductor cause a capacitance effect to shift the second high frequency band to be close to the first high frequency band. It can cover various wireless communication frequency bands.

20 Claims, 5 Drawing Sheets

| | Frequency (MHZ) | VSWR |
|---|---|---|
| Mkr1 | 824 | 4.445 |
| Mkr2 | 880 | 1.929 |
| Mkr3 | 960 | 4.960 |
| Mkr4 | 1710 | 3.690 |
| Mkr5 | 1880 | 2.040 |
| Mkr6 | 1990 | 2.623 |
| Mkr7 | 2170 | 2.184 |

| | Frequency (MHZ) | Impedance |
|---|---|---|
| Mkr1 | 824 | 174.40Ω<br>j90.942Ω<br>17.565nH |
| Mkr2 | 880 | 36.565Ω<br>-j25.436Ω<br>7.110pF |
| Mkr3 | 960 | 11.571Ω<br>j18.224Ω<br>3.021nH |
| Mkr4 | 1710 | 139.90Ω<br>-j75.504Ω<br>1.233pF |
| Mkr5 | 1880 | 52.614Ω<br>j37.253Ω<br>3.154nH |
| Mkr6 | 1990 | 2.623Ω<br>j55.937Ω<br>4.474nH |
| Mkr7 | 2170 | 2.184Ω<br>-j15.511Ω<br>4.729pF |

| GSM | | | | | |
|---|---|---|---|---|---|
| Frequency (MHZ) | 824 | 836 | 849 | 869 | 880 |
| Tot. Rad. Pwr. (dBm) | -2.80718 | -2.20693 | -1.47014 | -1.35091 | -1.3286 |
| Peak EIRP (dBm) | 0.125022 | 0.990195 | 1.92574 | 1.96301 | 2.23997 |
| Efficiency (%) | 52.39405 | 60.15989 | 71.28301 | 73.2671 | 73.64445 |
| Average Efficiency (%) | 66.14969796 | | | | |

| EGSM | | | | | | | |
|---|---|---|---|---|---|---|---|
| Frequency (MHZ) | 881 | 894 | 902 | 915 | 925 | 942 | 960 |
| Tot. Rad. Pwr. (dBm) | -1.32094 | -1.25462 | -1.34922 | -1.63359 | -1.97096 | -2.28777 | -3.00203 |
| Peak EIRP (dBm) | 2.26706 | 2.40143 | 2.37406 | 2.06345 | 1.5024 | 1.32286 | 0.884724 |
| Efficiency (%) | 73.77445 | 74.90969 | 73.29562 | 68.65007 | 63.51905 | 59.05042 | 50.0953 |
| Average Efficiency (%) | 66.18494374 | | | | | | |

| DCS | | | | | | |
|---|---|---|---|---|---|---|
| Frequency (MHZ) | 1710 | 1747 | 1785 | 1805 | 1842 | 1850 |
| Tot. Rad. Pwr. (dBm) | -2.98932 | -2.22993 | -1.22982 | -1.25759 | -1.5448 | -1.49412 |
| Peak EIRP (dBm) | 5.05482 | 5.48752 | 5.56058 | 5.18112 | 4.41688 | 4.42349 |
| Efficiency (%) | 50.24213 | 59.84212 | 75.33868 | 74.85848 | 70.06804 | 70.89049 |
| Average Efficiency (%) | 66.87332427 | | | | | |

FIG. 4 A

| PCS | | | | | |
|---|---|---|---|---|---|
| Frequency (MHZ) | 1880 | 1910 | 1930 | 1960 | 1990 |
| Tot. Rad. Pwr. (dBm) | -1.714 | -1.55688 | -1.60034 | -1.76721 | -2.01976 |
| Peak EIRP (dBm) | 4.33799 | 4.44065 | 4.2669 | 4.07242 | 4.00695 |
| Efficiency (%) | 67.39071 | 69.87342 | 69.17768 | 66.57007 | 62.80931 |
| Average Efficiency (%) | 67.16423614 | | | | |

| IMT-2000 | | | |
|---|---|---|---|
| Frequency (MHZ) | 2110 | 2140 | 2170 |
| Tot. Rad. Pwr. (dBm) | -1.82989 | -2.05995 | -2.14554 |
| Peak EIRP (dBm) | 4.74373 | 4.54133 | 4.6102 |
| Efficiency (%) | 65.61619 | 62.23074 | 61.01632 |
| Average Efficiency (%) | 62.9544173 | | |

FIG. 4 B

MULTI-BAND ANTENNA

BACKGROUND OF THE INVENTION

1. Field of the Invention

The invention relates to an antenna, more particularly, to a multi-band antenna for receiving various frequency bands.

2. The Related Art

An antenna for receiving and transmitting wireless signal is an important component in wireless device. Nowadays, wireless communication bands at telecommunication field includes: global system for mobile communications (GSM) band about 850 mega-hertz (MHz), extended global system for mobile communications (EGSM) band about 900 MHz, digital cellular system (DCS) band about 1800 MHz, personal conferencing specification (PCS) band about 1900 MHz, and international mobile telecommunications-2000 (IMT-2000) about 2100 MHz.

There are various types of antennas for the portable communication device to use, such as helix, monopole, inverted-F, dipole, patch, loop and retractable antennas. Helix antenna and retractable antenna are typically installed outside the portable communication device. Inverted-F antenna, monopole antenna, patch antenna, loop antenna and dipole antenna are typically embedded inside the portable communication device case or housing.

Generally speaking, the embedded antennas are more preferable than the external antennas for the portable communication device owing to mechanical and ergonomic reasons. Embedded antennas are protected by the wireless device case or housing and therefore tend to be more durable than external antennas. Therefore, the embedded antenna capable of operating at various wireless communication bands such as GSM band, EGSM band, DCS band, PCS band and IMT-2000 band is required, to become an essential component for the portable wireless communication device.

SUMMARY OF THE INVENTION

The object of the present invention is to provide a multi-band antenna having a ground portion, a radiating element, a tuning conductor, a short-circuit conductor and a feed point. The radiating element is spaced away from the ground portion. The tuning conductor is extended from the radiating element and parallel to the ground portion to form a gap therebetween. The short-circuit conductor interconnects to the ground portion and the radiating element. The feed point is disposed at the radiating element and adjacent to the short-circuit conductor.

The radiating element, the short-circuit conductor and the feed point function as a first inverted-F antenna obtaining a first high frequency band, and a second inverted-F antenna obtaining a low frequency band and a second high frequency band higher than the first high frequency band. The ground portion and the tuning conductor cause a capacitance effect to shift the second high frequency band to be close to the first high frequency band.

The low frequency band can cover at least two telecommunication frequency bands, and the first high frequency band and the second high frequency band can cover at least three telecommunication bands. Therefore, the multi-band antenna can operate at various telecommunication frequency bands.

BRIEF DESCRIPTION OF THE DRAWINGS

The present invention will be apparent to those skilled in the art by reading the following description of a preferred embodiment thereof, with reference to the attached drawings, in which:

FIG. 4B shows show various antenna characteristic value of the multi-band antenna.

DETAILED DESCRIPTION OF THE PREFERRED EMBODIMENT

Structures of the multi-band antenna described herein are sized and shaped to tune the multi-band antenna for operating at wireless telecommunication bands. In an embodiment of the invention described in detail below, the multi-band antenna has structure which is primarily associated with operating bands covering GSM band, EGSM band, DCS band, PCS band and IMT-2000 band.

Figure 1:
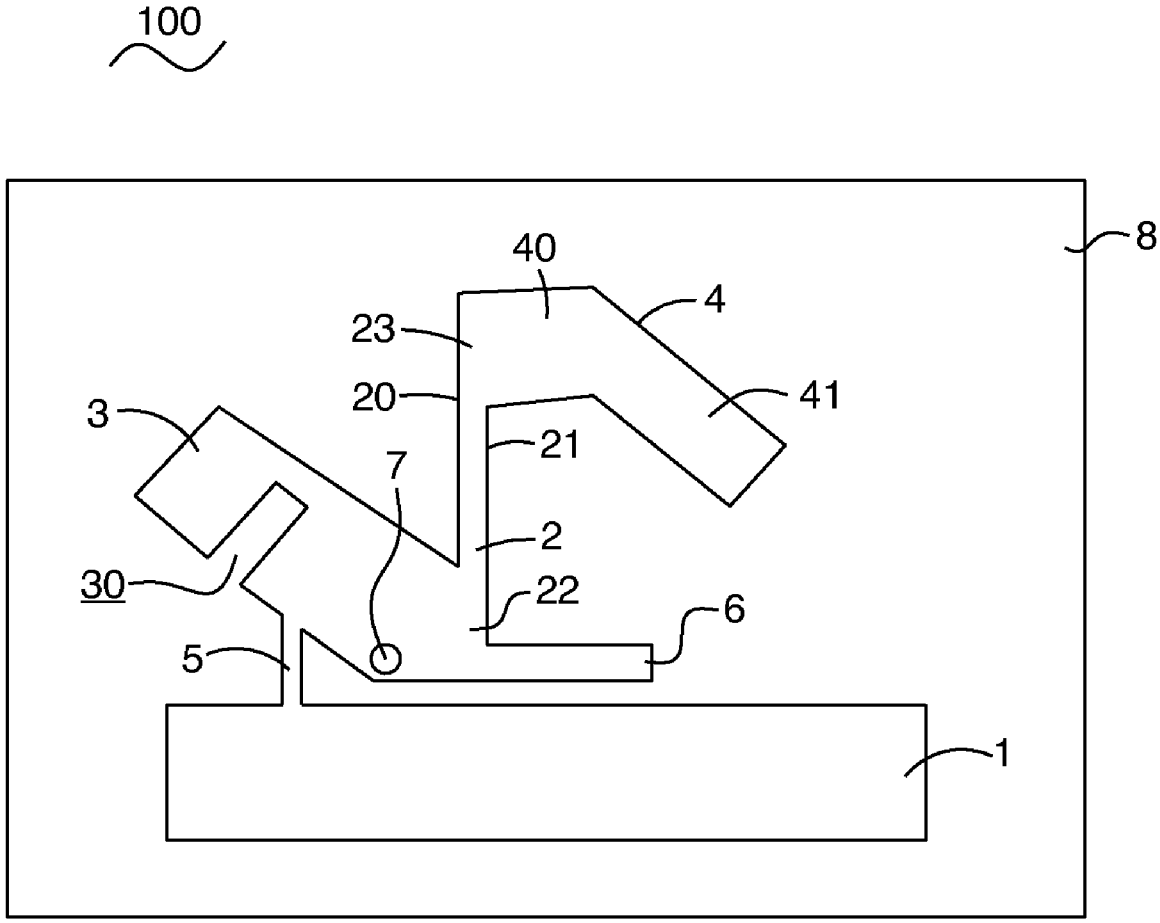
FIG. 1 is a planar view of a preferred embodiment of a multi-band according to the present invention.

Please refer to FIG. 1. A preferred embodiment of the multi-band antenna 100 according to the present invention is shown. The multi-band antenna 100 is made of metallic material and disposed on a dielectric substrate 8 such as a printed circuit board or a plastic plate. Furthermore, the multi-band antenna 100 can make of a metallic foil and stamping into a cubing shape.

The multi-band antenna 100 includes a ground portion 1, a first radiating conductor 2, a second radiating conductor 3, a third radiating conductor 4, a short-circuit conductor 5 and a tuning conductor 6. The first radiating conductor 2, the second radiating conductor 3, the third radiating conductor 4 and the tuning conductor 6 are all at the same side spaced from the ground portion 1 and connect with the ground portion 1 by the short-circuit conductor 5.

The first radiating conductor 2 defines a first side 20, a second side 21 opposite to the first side 20, a first end portion 22 and a second end portion 23 opposite to the first end 22. The first end portion 22 of the first radiating conductor 2 is adjacent the ground portion 1.

The second radiating conductor 3 extends from the first side 20 of the first end portion 22 of the first radiating conductor 2 and away from the ground portion 1. In this embodiment, between the first radiating conductor 2 and the second radiating conductor 3 there constitute an included acute angle.

The second radiating conductor 3 has a slot 30 defining an opening on the side near the ground portion 1. A feed point 7 is disposed at the second radiating conductor 3 and adjacent the first end portion 22 of the first radiating conductor 2.

The short-circuit conductor 5 interconnects the ground portion 1 and the second radiating conductor 3. One end of the short-circuit conductor 5 connects to the ground portion 1 and the other end of the short-circuit conductor 5 connects to the second radiating conductor 3 of which between the slot 30 and the feed point 7.

The third radiating conductor 4 extends from the second side 21 of the second end portion 23 of the first radiating conductor 2 and is bent towards the ground portion 1. The third radiating conductor 4 includes a first radiating section 40 and a second radiating section 41. The first radiating section 40 substantially extends from the second side 21, and interconnects the first radiating conductor 2 and the second radiating section 41.

In this embodiment, the first radiating section 40 is perpendicular to the first radiating conductor 2. The second radiating section 41 of the third radiating conductor 4 obliquely extends from the first radiating section 40 and is bent towards the ground portion 1. As a whole, the first radiating conductor 2, the second radiating conductor 3 and the third radiating conductor 4 are substantially formed in a N-shape.

The tuning conductor 6 extends from the second side 21 of the first end portion 22 of first radiating conductor 2. The tuning portion 6 is substantially parallel with and adjacent to the ground portion 1. The width of the gap between the tuning portion 6 and the ground portion 1 must be less than 3 millimeters. In this embodiment, the width of the gap between the tuning portion 6 and the ground portion 1 is 1.9 millimeters. Thus, the ground portion 1 and the tuning conductor 6 together function as a capacitance.

The ground portion 1, the second radiating conductor 3, the first radiating conductor 40 and the second radiating section 41 are substantially of rectangular shape. The first radiating conductor 2, the short-circuit conductor 5 and the tuning conductor 6 are substantially of thin-strip shape.

The ground portion 1, the second radiating conductor 3 and the short-circuit conductor 5 together function as a first inverted-F antenna and resonate at a first high frequency band covering 1800 MHz and 1900 MHz. The ground portion 1, the first radiating conductor 2, the third radiating conductor 4 and the short-circuit conductor 5 together function as a second inverted-F antenna and resonate at a low frequency band covering 850 MHz and 900 MHz, and a second high frequency band higher than 2100 MHz.

The capacitance effect caused by the ground portion 1 and the tuning portion 6 may affect the function of the second inverted-F antenna to shift the second high frequency band to be close to the first high frequency band to cover 2100 MHz.

Figure 2:
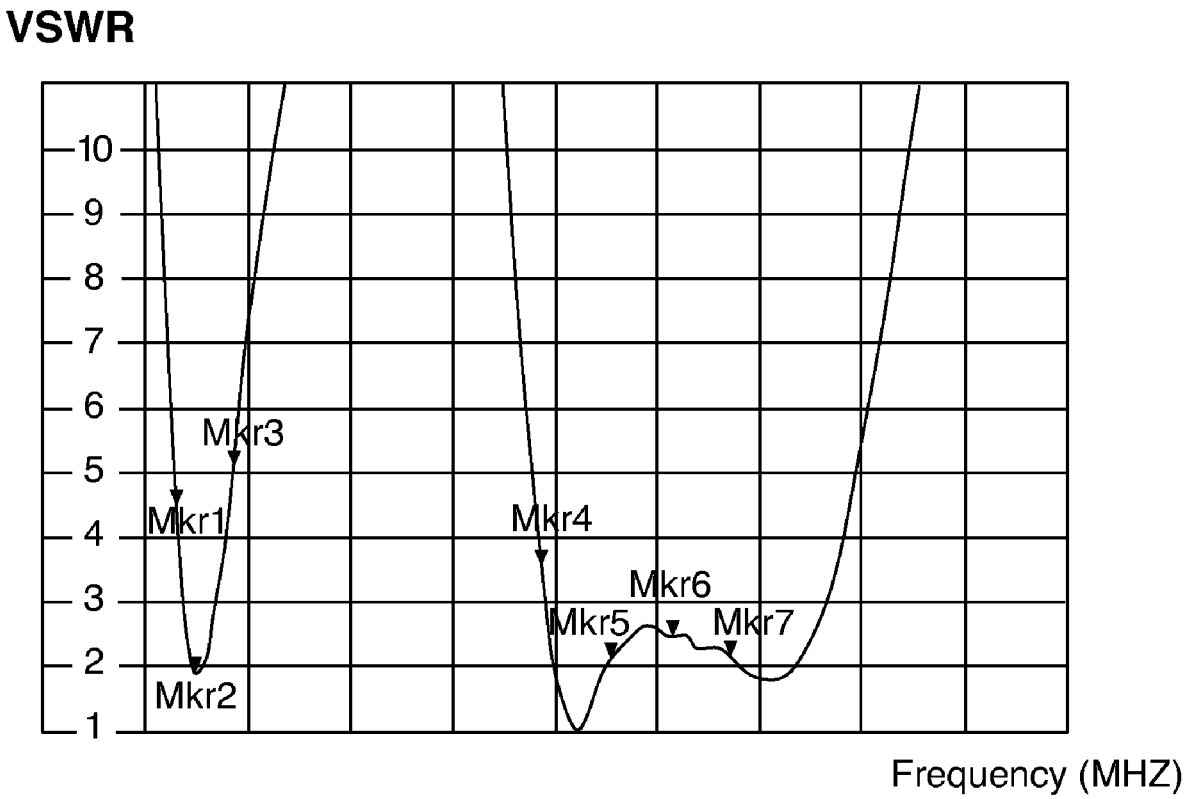
FIG. 2 shows a Voltage Standing Wave Ratio (VSWR) test chart of the multi-band antenna.

Please refer to FIG. 2, which shows a Voltage Standing Wave Ratio (VSWR) test chart of the multi-band antenna 100. While the multi-band antenna 100 operates at 824 MHz, the VSWR value is 4.445 (sign Mkr1 in Figures). While the multi-band antenna 100 operates at 880 MHz, the VSWR value is 1.929 (sign Mkr2 in Figures). The VSWR value is 4.96 (sign Mkr3 in Figures), While the multi-band antenna 100 operates at 960 MHz.

While the multi-band antenna 100 operates at 1710 MHz, the VSWR value is 3.69 (sign Mkr4 in Figures). While the multi-band antenna 100 operates at 1880 MHz, the VSWR value is 2.04 (sign Mkr5 in Figures). While the multi-band antenna 100 operates at 1990 MHz, the VSWR value is 2.623 (sign Mkr6 in Figures). While the multi-band antenna 100 operates at 1990 MHz, the VSWR value is 2.184 (sign Mkr7 in Figures).

Figure 3:
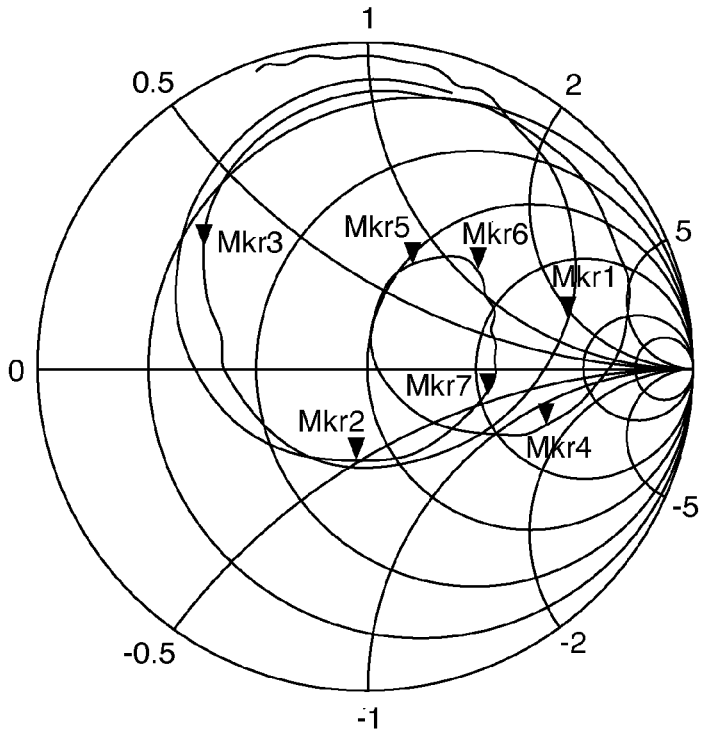
FIG. 3 shows a Smith Chart recording impedance of the multi-band antenna; and FIG. 4A

Please refer to FIG. 3, which shows a smith chart recording impedance of the multi-band antenna 100. The multi-band antenna 100 exhibits an impedance of 174.4 Ohm at 824 MHz, an impedance of 36.565 Ohm at 880 MHz, an impedance of 11.571 Ohm at 960 MHz, an impedance of 139.9 Ohm at 1710 MHz, an impedance of 52.614 Ohm at 1880 MHz, an impedance of 2.623 Ohm at 1990 MHz and an impedance of 2.184 at 2170 MHz.

Please refer to FIG. 4A and FIG. 4B, which show various antenna characteristic value of the multi-band antenna 100. The multi-band antenna 100 exhibits a total radiant power between −1.33 dBm and −2.81 dBm, a peak effective isotropically radiated power (peak EIRP) between 0.99 dBm and 2.24 dBm, and an average efficiency about 66.15 percents at GSM frequency band.

The multi-band antenna 100 exhibits a total radiant power between −1.25 dBm and −3 dBm, a peak EIRP between 0.88 dBm and 2.4 dBm, and an average efficiency about 66.18 percents at EGSM frequency band. The multi-band antenna 100 exhibits a total radiant power between −1.23 dBm and −2.99 dBm, a peak effective isotropically radiated power (peak EIRP) between 4.42 dBm and 5.56 dBm, and an average efficiency about 66.87 percents at DCS frequency band.

The multi-band antenna 100 exhibits a total radiant power between −1.56 dBm and −2.02 dBm, a peak EIRP between 4.01 dBm and 4.44 dBm, and an average efficiency about 67.16 percents at PCS frequency band. The multi-band antenna 100 exhibits a total radiant power between −1.83 dBm and −2.15 dBm, a peak effective isotropically radiated power (peak EIRP) between 4.54 dBm and 4.74 dBm, and an average efficiency about 62.95 percents at IMT-200 frequency band.

As described above, the ground portion 1, the second radiating conductor 3 and the short-circuit conductor 5 together function as the first PIFA antenna covering DCS frequency band and PCS frequency band. The ground portion 1, the first radiating conductor 2, the third radiating conductor 4 and the short-circuit conductor 5 together function as a second PIFA antenna covering GSM frequency band and EGSM frequency band.

The capacitance effect caused by the ground portion 1 and the tuning portion 6 affect the function of the second PIFA antenna to cover IMT-2000 frequency band. Thus, the multi-band antenna 100 can operate at various wireless telecommunication band including GSM band, EGSM band, DCS band, PCS band and IMT-2000 band.

Furthermore, the present invention is not limited to the embodiments described above; various additions, alterations and the like may be made within the scope of the present invention by a person skilled in the art. For example, respective embodiments may be appropriately combined.

What is claimed is:

1. A multi-band antenna, comprising:

a ground portion;

a first radiating conductor away from the ground portion, defining a first side, a second side opposite to the first side, a first end portion adjacent to the ground portion and a second end portion opposite to the first end portion;

a second radiating conductor extending from the first side of the first end portion of the first radiating conductor and away from the ground portion;

a third radiating conductor extending from the second side of second end portion of the first radiating conductor and bent towards the ground portion;

a tuning conductor extending from the second side of the first end of the first radiating conductor and parallel with the ground to form a gap therebetween;

a short-circuit conductor interconnecting the ground portion and the second radiating conductor; and a feed point disposed at the second radiating conductor and adjacent to the first radiating conductor.

2. The multi-band antenna as claimed in claim 1, wherein the second radiating conductor comprises a slot starting from one edge thereof and extending thereinto, one end of the short-circuit conductor connects to the ground portion, and the other end connects to the second radiating conductor of which between the feed point and the slot.

3. The multi-band antenna as claimed in claim 1, wherein the third radiating conductor comprises a first radiating section extending from the second side of the second end portion of the first radiating conductor and a second radiating section extending from the free end of the first radiating section and bent towards the ground portion.

4. The multi-band antenna as claimed in claim 3, wherein the first radiating section perpendicularly extends from the first radiating conductor and the second radiating section obliquely extends from the first radiating section.

5. The multi-band antenna as claimed in claim 1, wherein the ground portion, the first radiating conductor, the second radiating conductor, the third radiating conductor, the short-circuit conductor and the tuning portion dispose on a substrate.

6. The multi-band antenna as claimed in claim 1, wherein the ground portion, the first radiating conductor, the second radiating conductor, the third radiating conductor, the short-circuit conductor and the tuning portion make of a metallic foil by stamping.

7. The multi-band antenna as claimed in claim 1, wherein the width of the gap is less than 3 millimeters.

8. The multi-band antenna as claimed in claim 1, wherein the first radiating conductor, the second radiating conductor and the third radiating conductor are substantially of a N-shape.

9. A multi-band antenna, comprising:

a ground portion;

a first radiating conductor spaced from the ground portion, defining a first end portion adjacent to the ground portion and a second end portion opposite to the first end portion;

a second radiating conductor extending from the first end portion of the first radiating conductor;

a third radiating conductor extending from the second end portion of the first radiating conductor;

a tuning conductor extending from the first end of the first radiating conductor and adjacent to the ground portion;

a short-circuit conductor interconnecting the ground portion and the second radiating conductor; and a feed point disposed at the second radiating conductor and adjacent to the first radiating conductor;

wherein the combination of the ground portion, the second radiating conductor and the short-circuit conductor functions as a first inverted-F antenna obtaining a first high frequency band;

wherein the combination of the ground portion, the first radiating conductor, the third radiating conductor, and the short-circuit conductor functions as a second inverted-F antenna obtaining a low frequency band and a second high frequency band;

wherein the ground portion and the tuning conductor cause a capacitance effect to shift the second high frequency band.

10. The multi-band antenna as claimed in claim 9, wherein the second radiating conductor extends from a first side of the first radiating conductor and away from the ground portion, the third radiating conductor extends from a second side of the first radiating conductor which is opposite to the first side, and bent towards the ground portion, the tuning conductor extends from the second side of the first radiating conductor and parallel with the ground portion to form a gap therebetween.

11. The multi-band antenna as claimed in claim 9, wherein the second radiating conductor comprises a slot starting from one edge thereof and extending thereinto, one end of the short-circuit conductor connects to the ground portion, and the other end connects to the second radiating conductor of which between the feed point and the slot.

12. The multi-band antenna as claimed in claim 9, wherein the third radiating conductor comprises a first radiating section extending from the second side of the second end portion of the first radiating conductor and a second radiating section extending from the free end of the first radiating section and bent towards the ground portion.

13. The multi-band antenna as claimed in claim 12, wherein the first radiating section perpendicularly extends from the first radiating conductor and the second radiating section obliquely extends from the first radiating section.

14. The multi-band antenna as claimed in claim 9, wherein the ground portion, the first radiating conductor, the second radiating conductor, the third radiating conductor, the short-circuit conductor and the tuning portion are disposed on a substrate.

15. The multi-band antenna as claimed in claim 9, wherein the ground portion, the first radiating conductor, the second radiating conductor, the third radiating conductor, the short-circuit conductor and the tuning portion make of a metallic foil by stamping.

16. The multi-band antenna as claimed in claim 9, wherein the width of the gap is less than 3 millimeters.

17. The multi-band antenna as claimed in claim 9, wherein the first radiating conductor, the second radiating conductor and the third radiating conductor are substantially of a N-shape.

18. A multi-band antenna, comprising:

a ground portion;

a radiating element spaced from the ground portion comprising a first radiating conductor;

a second radiating conductor and a third radiating conductor extending from opposite ends of the first radiating conductor respectively;

a tuning conductor extending from the first radiating conductor and substantially parallel to the ground portion to form a gap therebetween;

a short-circuit conductor interconnecting the ground portion and the radiating element; and a feed point disposed at the radiating element and adjacent to the short-circuit conductor;

wherein the combination of the radiating element, the short-circuit conductor and the feed point functions as a first inverted-F antenna obtaining a first high frequency band, and a second inverted-F antenna obtaining a low frequency band and a second high frequency band higher than the first high frequency band, the ground portion and the tuning conductor cause a capacitance effect to shift the second high frequency band to be close to the first high frequency band.

19. The multi-band antenna as claimed in claim 18, wherein the radiating element is substantially of a N-shape.

20. The multi-band antenna as claimed in claim 18, wherein the low frequency band covers at least two telecommunication frequency bands, the first high frequency band and the second high frequency band cover at least three telecommunication bands.

* * * * *